US005397510A

United States Patent [19]

Clark

[11] Patent Number: 5,397,510

[45] Date of Patent: Mar. 14, 1995

[54] CONTROL SYSTEM FOR HUMIDIFIERS

[75] Inventor: Robert Clark, Columbia, Mo.

[73] Assignee: Toastmaster Inc., Columbia, Mo.

[21] Appl. No.: 65,587

[22] Filed: May 24, 1993

[51] Int. Cl.[6] ..... B01F 3/04

[52] U.S. Cl. ..... 261/26; 261/107

[58] Field of Search ..... 261/26, 107

[56] References Cited

U.S. PATENT DOCUMENTS

| | | | |
|---|---|---|---|
| 314,616 | 2/1891 | Pepper . | |
| 796,557 | 8/1905 | Bockoven . | |
| 1,606,472 | 11/1926 | Kieffer et al. . | |
| 1,625,663 | 4/1927 | Kelly . | |
| 1,817,357 | 8/1931 | Fisher . | |
| 1,835,362 | 12/1931 | Williams . | |
| 2,054,200 | 9/1936 | Langford . | |
| 2,078,204 | 4/1937 | Manning et al. . | |
| 2,711,268 | 6/1955 | Cannella . | |
| 2,730,340 | 1/1956 | Patriarca . | |
| 2,749,725 | 6/1956 | Essman et al. . | |
| 2,956,417 | 10/1960 | Lyman . | |
| 3,152,723 | 10/1964 | Perl et al. . | |
| 3,341,073 | 9/1967 | Arps et al. . | |
| 3,465,915 | 9/1969 | de Harde . | |
| 3,598,370 | 8/1971 | Hoag | 261/26 |
| 3,637,194 | 1/1972 | Swimmer et al. | 261/26 |
| 3,656,507 | 4/1972 | Martinez . | |
| 3,811,661 | 5/1974 | Procter . | |
| 3,927,804 | 12/1975 | DeMan . | |
| 3,930,598 | 1/1976 | Slagle . | |
| 4,031,171 | 6/1977 | Asao et al. . | |
| 4,033,483 | 7/1977 | Neidorf . | |
| 4,087,495 | 5/1978 | Umebara . | |
| 4,135,370 | 1/1979 | Hosoda et al. . | |
| 4,186,848 | 2/1980 | Walter . | |
| 4,238,425 | 12/1980 | Matsuoka et al. . | |
| 4,257,989 | 3/1981 | Nishikawa . | |
| 4,338,576 | 7/1982 | Takahashi et al. . | |
| 4,663,091 | 5/1987 | Seo . | |
| 4,698,188 | 10/1987 | Gutmann . | |
| 4,712,713 | 12/1987 | Karlis et al. . | |
| 4,830,791 | 5/1989 | Muderlak et al. | 261/26 |
| 4,921,639 | 5/1990 | Chiu . | |
| 5,037,583 | 8/1991 | Hand . | |
| 5,108,663 | 4/1992 | Chiu | 261/26 |
| 5,143,656 | 9/1992 | Marino et al. | 261/26 |
| 5,223,182 | 6/1993 | Steiner et al. | 261/26 |
| 5,252,260 | 10/1993 | Schuman | 261/26 |

FOREIGN PATENT DOCUMENTS

| | | |
|---|---|---|
| 2256404 | 1/1974 | Germany . |
| 7437851 | 3/1975 | Germany . |
| 2510551 | 9/1976 | Germany . |
| 2604169 | 8/1977 | Germany . |
| 3332236 | 3/1985 | Germany . |
| 163823 | 11/1984 | Japan . |
| 180128 | 12/1984 | Japan . |
| 632134 | 7/1982 | Switzerland . |

*Primary Examiner*—Tim Miles

*Attorney, Agent, or Firm*—William B. Kircher

[57] ABSTRACT

A control system for a humidifier having operative components housed within a casing. The casing includes an upper portion which is removable to provide access to the interior such that a refillable water supply bottle may be removed from, and placed into, the casing. A first control system senses depletion of the water within the water bottle and activates an indicator or disables operation of the humidifier. This first control system includes a spring biased switch which presses laterally against a side of the water bottle. When the weight of the water bottle has sufficiently decreased, due to dispensing of the water therefrom, the spring bias may overcome the weight of the bottle to tip it slightly laterally, enabling the switch. A second control system is an interlock which disables operation of the humidifier upon the casing being open. A finger element extends downward from the lid of the casing and engages against a switch mounted within the casing. When the lid is removed to inspect the interior, or remove and replace the water bottle, the finger is removed from abutment against the switch, which allows the switch to open.

17 Claims, 2 Drawing Sheets

CONTROL SYSTEM FOR HUMIDIFIERS

BACKGROUND OF THE INVENTION

1. Field of the Invention

The present invention relates in general to humidifiers. In particular, the present invention relates to improved control systems to halt the operation of humidifiers upon certain sensed conditions or provide a signal upon such sensed conditions.

2. Description of the Related Art

Humidifiers for home use have been known for many years. Such humidifiers work upon one of several principles, such as a wicking humidifier or an ultrasonic humidifier. Regardless of the operating principal of the humidifier, such devices almost invariably include some type of control mechanism.

In the simplest form, such control mechanisms consist of an on/off switch to energize the motor and thus control operation of the humidifier. For several types of humidifiers, however, their particular arrangement and structural elements are such that additional control mechanisms may greatly aide in their operation or safety. For example, in wick and ultrasonic humidifiers it is often the case that the humidifier includes removable bottles of water which automatically dispense to increase the amount of time between provision of the humidifier with water, thus increasing its convenience to the user. In such an arrangement it has been known to provide sensors to detect the water level within the humidifier and/or the auxiliary water bottle, to notify the user as to a low water condition and/or to cease operation of the humidifier upon such a low water condition.

While sensors detecting the water directly (i.e. electric current passing through the water) could be placed within the bottle, such a sensor would have to be quite rugged, and therefore expensive, and additionally entails problems in communication from the sensor inside the bottle to the wiring of the humidifier outside the bottle. To avoid such problems, it has been known to sense not the actual presence (i.e. wetness) of the water, but rather the weight of the water. Arrangements which sense the water weight are shown in U.S. Pat. No. 2,956,417 to Lyman and DE 2 256 404 to Heißmeier. These patents relate to dehumidifiers, and thus obviously employ a reverse arrangement where switching occurs upon accumulation, rather than dispersal, of water. However, both of these arrangements support the water container with a biasing spring in a manner such that the weight of the water within the container determines the position of the container. The final desired weight (in this case a full container) will place the container in a position to cause switching.

A conceptually similar arrangement, though reversed for use as a humidifier, is disclosed in U.S. Pat. No. 5,037,583 to Hand. In the Hand patent a water bottle is supported upon a spring which tends to bias the water bottle upward. Resting below a downward directed shoulder of the water bottle is an upwardly biased switch which controls operation of the humidifier motor. When the water bottle is not depleted the combined weight of the bottle and water will compress the supporting spring to position the bottle at its lowest position, such that the switch is maintained in the closed position and the humidifier motor will operate. When the water has sufficiently depleted such that the weight of the water bottle is greatly reduced, the biasing spring will lift the water bottle, positioning the bottle at its highest position, allowing the switch to open, ceasing operation of the humidifier motor or providing a signal.

While this arrangement of Hand is serviceable, there are various drawbacks. For example, the placement of the biasing spring directly below the water tank, in conjunction with the properties of the spring, will result in the water bottle being moved progressively upward as its weight is reduced. As such, the physical characteristics of the spring, physical dimensions of the water bottle and placement and sensitivity of the switch must be fairly accurate to ensure that the switch is opened only after full depletion of the water within the bottle.

Additionally, the typical dispensing arrangement for such water bottles is a valve which is only opened when the bottle is in the lowered position. As such, the progressive upward movement of the water bottle during depletion may result in the valve closing prior to depletion, and in the worst case, closing prior to operation of the switch. This would result in the motor continuing to run after the supply of water has been exhausted, or no signal to the user.

Finally, this dispensing arrangement operates upon a vacuum principal, such that large bubbles of air travel upward through the water in the bottle during the dispensing. Where the water bottle is in a position supported solely by the biasing spring, these forces may result in a vertical oscillation of the water bottle, which may accidently open the switch prior to the desired time.

The Hand arrangement also does not allow for the possibility of the operator desiring to continue operation of the fan after depletion of the water, such as to fully dry the wicking elements prior to storage.

Humidifiers are also typically provided with covering hoods which hide the water bottles and interior mechanisms of the humidifier for aesthetic reasons. Removing such covers to gain access to the water bottles may expose the operating mechanism for the humidifier. As such, the user or the operating mechanism of the humidifier may be subject to danger.

SUMMARY OF THE INVENTION

An object of the present invention is to provide a control system for a humidifier to selectively provide a signal and/or deactivate the evaporation system in response to certain conditions.

Another object of the present invention is to provide such a control system which will reliably signal and/or deactivate upon depletion of the water supply thereto.

A further object of the present invention is to provide a humidifier with the water container supported by a biasing spring, but with the spring having a non-linear increasing force to ensure operation of the switching system.

Another object of the present invention is to provide a humidifier which may be placed in a condition to override the switching, and thus allow operation after water depletion.

A further object of the present invention is to provide such a humidifier in which the override arrangement is simple, mechanical, and does not require expensive electrical components to effect the override.

Yet another object of the present invention is to provide such a control system which will reliably deactivate the evaporation system upon opening of the outer casing of such humidifier.

These and other objects are achieved by a control system for a humidifier having operative components housed within a casing. The casing includes an upper portion which is removable to provide access to the interior such that a refillable water supply bottle may be removed from, and placed into, the casing. A first control system senses depletion of the water within the water bottle and causes a signal or disables operation of the humidifier. This first control system includes a spring biased switch which presses laterally against a side of the water bottle. When the weight of the water bottle has sufficiently decreased, due to dispensing of the water therefrom, the spring bias may overcome the weight of the bottle to tip it slightly laterally about a line of contact spaced laterally from the center of gravity of the bottle, enabling the switch. The spring biased switch may be selectively placed in a position physically blocked from movement to override the first control system. A second control system is an interlock which disables operation of the humidifier upon the casing being open. A finger element extends downward from the lid of the casing and engages against a switch mounted within the casing. When the lid is removed to inspect the interior, or remove and replace the water bottle, the finger is removed from abutment against the switch, which allows the switch to operate.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
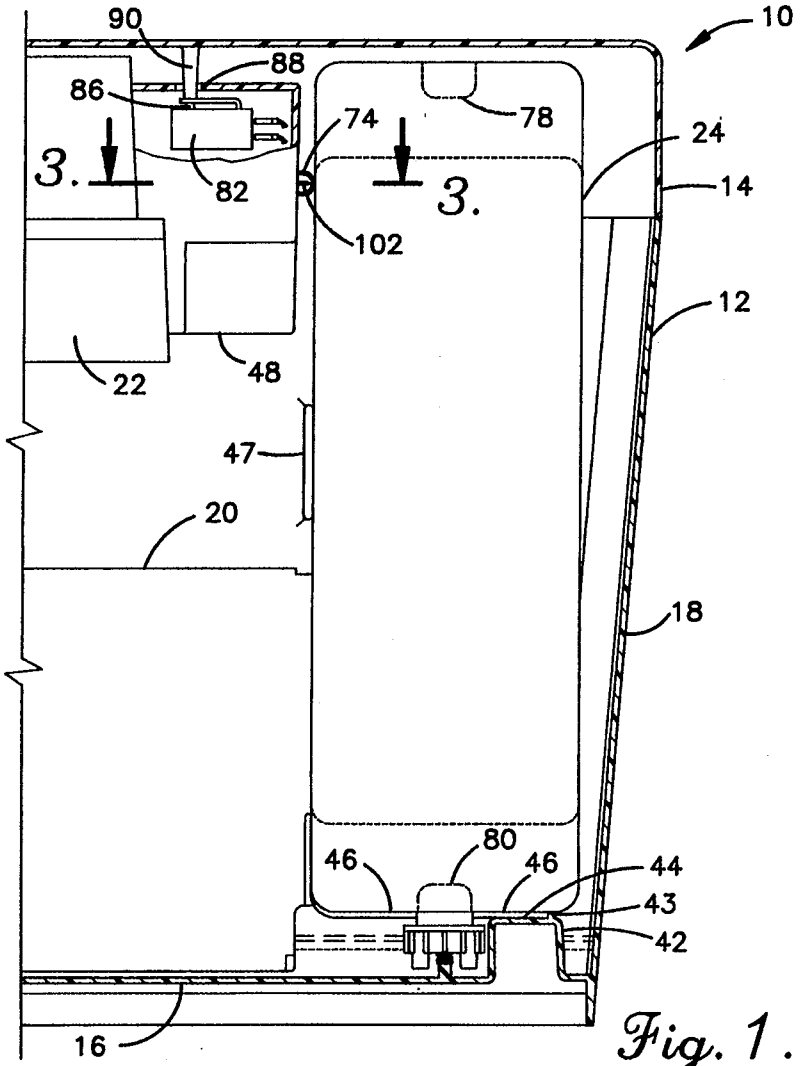
FIG. 1 is a side view in partial cross-section of a humidifier having control systems according to the present invention.

With reference to FIG. 1, a humidifier embodying control systems according to the present invention is generally designated by reference numeral 10. The humidifier 10 includes an outer casing defined by a base 12 and lid 14. The base 12 includes a bottom 16 and upwardly extending sidewalls which define an interior cavity. The opening to this interior cavity is closed by the lid 14 such that the casing preferably defines a substantially closed compartment.

Mounted within the casing are the various components which serve to introduce moisture into the air outside of the casing and generally referred to as the evaporation system. Such components may include one or more wick elements 20 each having one edge adjacent the bottom 16, and a fan 22 having an appropriate motor and power and control circuitry. It is the control circuitry which forms the present invention, and such control circuitry may be employed with humidifiers having operative components other than those shown, such as ultrasonic humidifiers. It is to be understood that those operative components shown are for illustration purposes, and are greatly simplified for clarity.

Also located within the casing is at least one removable water container or water bottle 24. The water bottle 24 acts as a reserve supply of water which is automatically dispensed into the casing and retained by the bottom and sidewalls.

Figure 7:
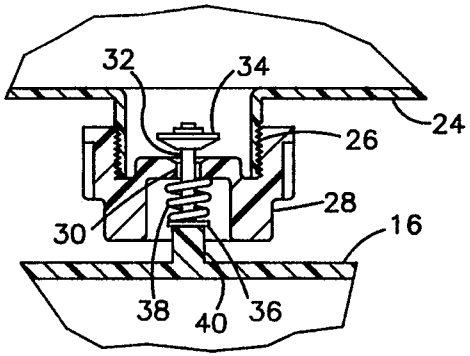
FIG. 7 is a detail view in partial cross-section showing the dispensing cap of the water bottle associated with the present humidifier.

While various forms of water containers and dispensing arrangements may be employed, one common dispensing arrangement is illustrated by FIG. 7. As shown in this figure, the bottle 24 includes a neck 26 having exterior threads adjacent its free end, and forming an access opening to the interior of bottle 24. A cap 28 is threaded upon the neck 26 and includes an opening 30 extending therethrough.

Received within opening 30 is a rod 32 having a diameter smaller than that of opening 30. A first end of rod 32, located within the neck 26 in the position shown in FIG. 7, includes a valve or stopper 34 adapted to seat against opening 30 and close same against egress of water through the opening. A second end of rod 32 includes a stop 36, and a coil spring 38 is mounted about rod 32 between an exterior face of cap 28 and the stop 36. As such, the spring 38 will tend to force the stop 36 outwardly from the cap, forcing the stopper 34 into the opening 30 to close same.

This arrangement allows the user to place the bottle 24 in a position such that the neck 26 is uppermost, remove the cap 28 and fill the bottle with water. Thereafter the cap may be placed back upon the neck 28 and the bottle inverted to the position of FIGS. 1 and 2. Due to the presence of the spring and stopper, however, no water will exit from the bottle as the user transports the bottle from the faucet to the humidifier. The bottle is then placed within the humidifier with the neck 26 facing downward such that the cap 28 rests upon, or is in proximity to, the bottom 16 of the casing.

The bottom 16 is provided with a protrusion 40 extending upwardly from the bottom and positioned at a location corresponding to that of the rod 32 when the bottle is in the operative position. The protrusion 40 has a vertical extent such that the stop 36 will engage with the protrusion and move vertically upward with respect to the cap 28. This will cause the stopper 34 to move away from opening 30, thus allowing the water within the bottle 24 to flow outward through the opening 30 and into the lower part of the casing. The water will continue to exit from the bottle 24 until it has reached a depth in the base (indicated by long dashed lines in FIG. 1) equal to or above the opening 30.

As is known in the art, this failure of the water bottle to completely drain is due to the vacuum created within the upper portion of the water bottle. Specifically, water will initially flow from the opening 30 into the casing. When a sufficient vacuum has been created within the water bottle due to water exiting therefrom, the flow of water outwardly from the opening 30 will cease, and air will flow inward through the opening 30 to create a bubble of air which will rise within the water bottle to relieve such vacuum. Water will then continue to flow again until another vacuum is created, and another air bubble passes through the opening 30. However, when the water has reached a level equal to or above the opening 30, the water surrounding the opening 30 will prevent air from passing into the opening 30 to relieve the vacuum within the water bottle. As such, the vacuum within the bottle is unrelieved and the flow of water outwardly through the opening 30 is halted. This arrangement is commonly employed in humidifiers to maintain the water within the casing at a specified level, which may be determined by the location of the opening 30 of the bottle with respect to the casing.

Figure 2:
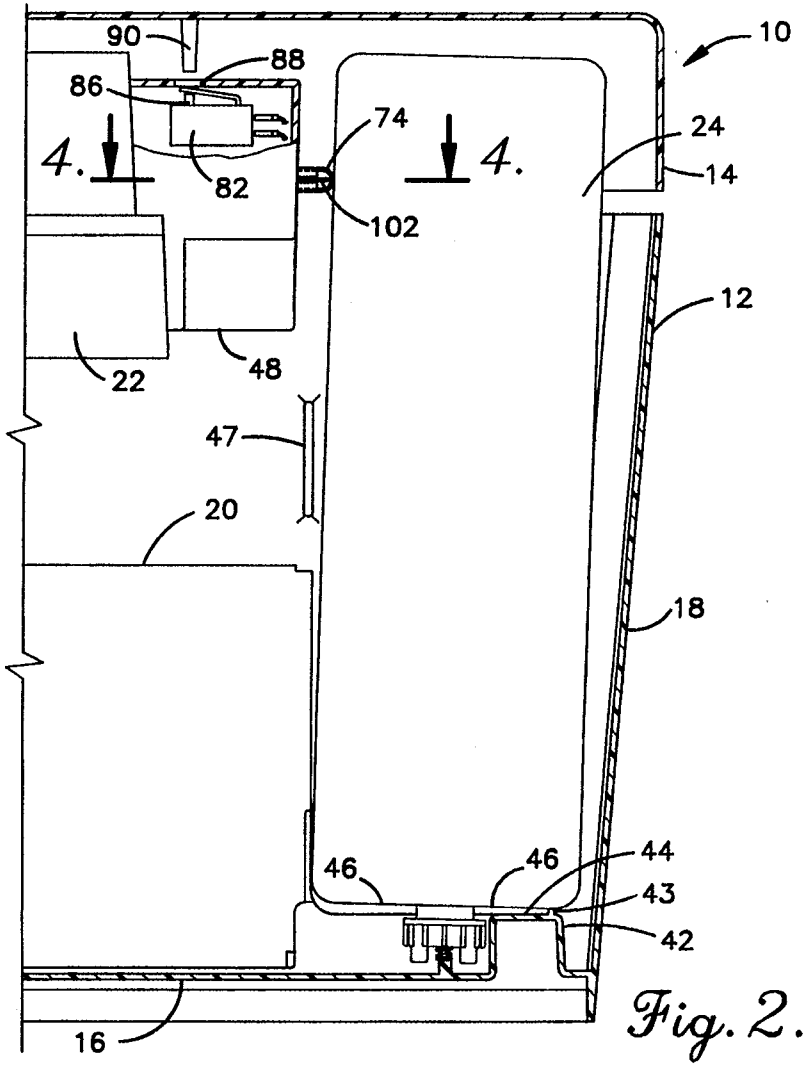
FIG. 2 is the humidifier of FIG. 1 with the switches for the control systems activated.

To maintain a sufficient depth of water within the casing it is typically necessary to space the opening 30, and thus the cap 28, a slight distance above the bottom 16 of the casing. To ensure such spacing the water bottle 24 may rest with its upper surface in abutment with a support 42 extending upwardly from the bottom 16. As shown in FIGS. 1 and 2, it is preferred that the support 42 be formed as a monolithic portion of the bottom 16.

The support 42 will bear the weight of the bottle 24 and thus support it against downward movement. However, for operation of the control system according to the present invention it is preferred that the support 42 be formed such that pivotal movement, substantially about a horizontal axis near the vertically lower end of the bottle, be allowed. A preferred arrangement is shown in FIGS. 1 and 2. In this preferred arrangement, the support 42 has a generally U-shaped configuration in plan view (similar to that shown in FIG. 3), with the cap 28 of the bottle received between the free legs of the U shape to guide the bottle to the proper position.

The bottle includes shoulders 46 extending laterally away from the neck, with the shoulders being substantially planar and may have an area substantially corresponding to that of the support 42. A pivot ridge 43 extends upwardly from the support 42, and has a narrow width but is elongated in the direction of the cross bar formed by the U-shaped support 42. The pivot ridge 43 will support the bottle when it is in the operative position of FIGS. 1 and 2, and forms a line contact with the bottle which will allow the bottle to pivot thereon. An important aspect of the present invention is that this line contact (and thus the pivot ridge) is spaced laterally from the center of gravity (typically the center line) of the bottle 24. This offset will cause the bottle to tend to rotate about the pivot ridge in the counterclockwise direction for the bottle of FIG. 1 (taking a vector perpendicular to the line contact and passing through the center of gravity, and a weight vector from the center of gravity, the cross product of these vectors will define a resultant vector, with rotation of the bottle being parallel to the resultant vector about an axis (the line contact) and in a direction corresponding to the right-hand rule).

It is noted that the pivot ridge 43 need not be continuous, but could include two or more ridges aligned in a row. Furthermore, the planar arrangement of the bottle shoulders and upper face of the support 42 could be varied to include mating or mirror image tapers. All that is strictly required is that the bottle may freely pivot about the ridge(s) 43, with this pivoting being offset from the center of gravity of the bottle.

Figure 3:
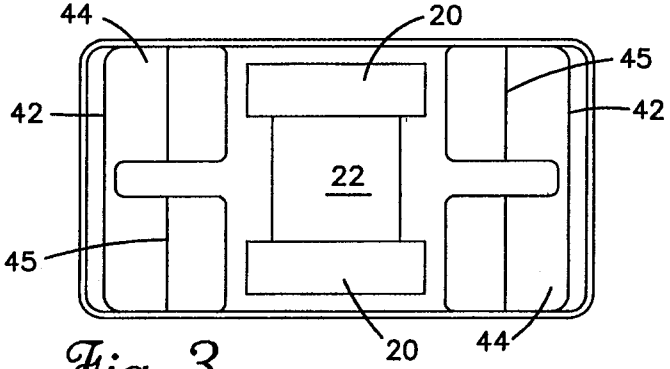
FIG. 3 is a plan view showing the interior of the humidifier according to a second embodiment.

Other arrangement could of course be employed to support the bottle along a line contact offset from the center of gravity. For example, the bottle could include shoulders 46 which have a slight tapper away from the cap 28 towards the lateral sides of the bottle. As is shown in FIG. 3, the support 42 could then include an upper surface 44 having a corresponding, yet greater taper, with the line 45 indicating a central trough line from which the upper surface tapers upward on either side. For example, the shoulders of the bottle could form a taper of one degree from horizontal, while the surface 44 forms a taper of one and one-half degrees from horizontal (the difference in the tapers being exaggerated in the figures for clarity).

The differing angles will result in the bottle and surface 44 abutting along a pair of line contacts, and the greater angle of the surface will ensure that these contact lines are spaced or offset laterally from the centerline (or more specifically the center of gravity) of the bottle. This lateral offset of the supporting line(s) of contact is an important aspect of the present invention.

To maintain the bottle in an upright position as shown in FIG. 1, the humidifier may include means forming an abutment against such pivoting. The abutment means could be the wicking elements 20 (and more particularly a frame surrounding the wicking material) or could be an abutment wall 47 extending outward from the sidewalls and/or bottom of the casing, both as shown in FIG. 1. Such abutment means may not be required, as is pointed out below.

Figure 4:
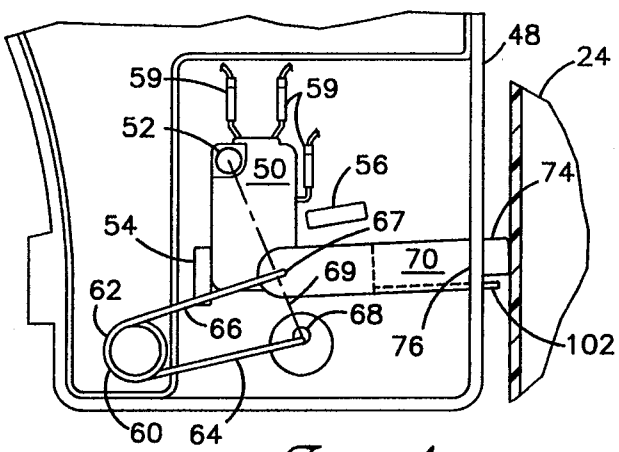
FIG. 4 is a detail view showing a switch according to a first control system in a first position.
Figure 5:
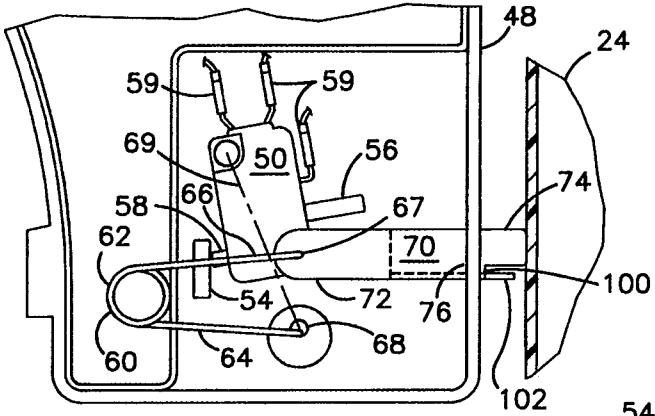
FIG. 5 is a detail view showing the switch of FIG. 3 in a second position.

Another element of the control system of the present invention is a biased abutment adapted to contact the water bottle. In particular, there is provided a component support or brace 48 which is fixed to the side wall 18 of the base of the casing. This brace 48 may preferably be formed as a portion of the support structure to maintain the fan 22, or other components, in their desired positions. As is best shown in FIGS. 4 and 5, a control switch 50 is mounted to brace 48 such that it pivots about a rod 52. First and second pivot stops 54 and 56 are provided at positions spaced from the rod 52, but within the arc defined by pivotal movement of control switch 50, such that the pivot stops 54 and 56 define the limits of pivotal movement for the switch 50.

The stops 54 and 56 are arranged such that when the switch 50 is in abutment with the first pivot stop 54 an actuator 58 (FIG. 5) of the switch 50 will be pressed inward to a first condition of the switch, as shown in FIG. 4. The second position of the switch 50 is shown in FIG. 5 where the switch 50 has rotated about the rod 52 into a position of abutment against the second pivot stop 56. In this second position the actuator 58 will extend outwardly from the switch 50 to place the switch in a second condition. These two positions of the switch, and in particular the actuator 58, will define two electrical states of the switch and determine the output through wires 59 connected to the switch.

As is well known in the art, the actuator 58 of switch 50 includes a biasing spring (not shown) which tends to bias the actuator to the extended position shown in FIG. 5. As such, the switch 50 will tend to move toward the position shown in FIG. 5. To assist in this there is provided a spring 60. While there are other spring configurations or other biasing means which could be employed, it is preferred that the spring 60 provide an increasing force as it moves from the position of FIG. 4 to the position of FIG. 5. To achieve this, the spring 60 includes one or more torsion coils 62 having a spiral configuration about an axis substantially parallel to that of rod 52, and first and second attachment arms 64 and 66, preferably formed as a monolithic unit with the coils 62.

The first attachment arm 64 is fixed to the brace 48 at a pivot axis 68, preferably by forming a hooked end on the attachment arm which is received within a hole in brace 48, and parallel to rod 52. The second attachment arm 66 is connected to the switch 50, preferably by forming a hooked end on this second attachment arm which is received within a spring pivot point 67 within switch 50. This pivot point 67 is spaced from the rod 52 and is also parallel thereto.

The placement of the pivot axis 68 with respect to pivot point 67 and pivot rod 52 is such that the free ends of the attachment arms 64 and 66 will be spaced a greater distance apart when the switch is in the configuration shown in FIG. 5. As such, when the switch is in the first position shown in FIG. 4, a greater biasing force will be present within the coils 62 which will attempt to spread apart the free ends of the attachment arms. This will tend to bias the switch 50 to the second position shown in FIG. 5. However, the biasing force of the coils will lessen as the attachment arms move farther apart.

To counteract this effect and provide the desired increasing spring force, the configuration of the various points of rotation are specially chosen. As may be envisioned, the force exerted by the spring is essentially in a direction outward through an imaginary line connecting the free ends of the spring attachment arms 64 and 66. In the position of FIG. 4 the spring is in its greatest compression, and thus exerting its greatest force. However, this spring force is nearly aligned with an imaginary line 69 passing through the pivot axis 68 and pivot rod 52, since the pivot point 67 is very near line 69. This near alignment means that the component of the spring force tangential to the rotation of the switch about rod 52 (and perpendicular to the imaginary line 69) is quite small in comparison to the total spring force. As such, there is only a slight tendency of the spring to cause rotation of the switch in this position.

In the second position of FIG. 5, it can be seen that the rotation of the switch results in movement of pivot point 67 to a position more distant from line 69. The direction of the spring force is thus rotated, causing a greater percentage of the spring force to be directed tangential to the rotation of the switch. As such, even though the total amount of spring force may be reduced due to expansion of the spring, the force tending to cause rotation of the switch can, and preferably does, increase. This increase in the rotation force is a great advantage in the present invention, as will be discussed more fully below.

The hooked end of the second attachment arm 66 passes through a first end 72 of a switch link 70 prior to connecting to the switch 50 at pivot point 67, and forms a pivot for this end 72. A second end 74 of switch link 70 passes through a guide hole 76 formed through the brace 48. This passage through the guide hole 76 ensures that the second end 74 of the switch link will be maintained in the desired position, which is extending toward and into contact with a lateral face of the bottle 24.

As may be readily seen by comparison of FIGS. 4 and 5, the pivotal movement of switch 50 about pivot rod 52 from the first position to the second position will cause the second end 74 of the switch link to move outward with respect to the brace 48. Conversely, pressure applied to the free second end of switch link 70 will tend to force the switch link inward with respect to brace 48, thus pivoting the switch 50 from the position shown in FIG. 5 to the position shown in FIG. 4. As noted above, the brace 48, switch and/or switch link are so located and configured such that the switch link abuts against a face of the bottle 24. In particular, when the bottle is resting upon both supports 42 the lateral face of the bottle will force the switch link inwardly to the first position of FIG. 4.

Due to the presence of spring 60, the switch link 70 must be subject to a predetermined force before it is moved inwardly of brace 48. However, once the switch link has been moved inward a sufficient distance such that the actuator 58 is moved to its innermost position, the switch 50 will be placed in abutment against first pivot stop 54, such that further inward movement of switch link 70 is prohibited.

Because of this abutment, it may be possible for a given design to eliminate the particular abutment means discussed above for preventing rotation of the bottle. Specifically, the bottle may not need to rest against the wicking element or abutment wall 47 in the position of FIG. 1 if the switch link, switch, first pivot stop arrangement is sufficiently rugged to form the abutment means by itself. This of course depends upon the strength of the switch elements, weight of the bottle and other engineering factors. For some designs it will be preferred that the abutment means also include the wicking element, abutment wall 47, etc. If such additional abutment means is employed, it is located such that in the position of FIG. 1 the switch will be placed in the position of FIG. 4.

This arrangement is employed such that the switch 50 may be used to determine if the bottle 24 has dispensed all, or nearly all of the water therefrom.

Specifically, the weight of the bottle 24 and the water contained therein may be represented by a resultant weight force which passes downward through the center of gravity (typically corresponding to the center line) of the bottle 24. The resultant weight force is resisted from below by the support 42, and in particular the line(s) of contact laterally spaced from the center of gravity. Additionally, the switch link 72 abuts against a lateral face of the bottle at a position spaced vertically from the supports 42, with the spring 60 (and actuator 58) causing the switch link to transmit a switch force laterally against the bottle, and thus substantially perpendicular to the lines of contact supporting the bottle.

This arrangement may be viewed as moments acting about the line(s) of contact. Where two lines of contact are employed (i.e. the embodiment of FIG. 3), the left line of contact is in a position such that the weight force and the switch force both tend to create a clockwise moment about such line which is resisted by the force exerted by the right line of contact. The right line of contact (or single line of contact in the embodiment of FIGS. 1 and 2) is positioned such that the weight force creates a counter clockwise moment resisted by a clockwise moment caused at least by the switch force, and possibly by the force exerted by the left line of contact or by additional abutment means, if either are employed. As will be more apparent below, the portion of the support 42 about which the weight force and spring force create moments in opposite directions is the portion which is of most importance, as is the presence of the oppositely directed moments.

When the bottle is full of water the weight force is much greater than the switch force (by design), and as such the bottle is supported on the line(s) of contact, and presses the switch link inward to the first position of FIG. 4. However, as the water is dispensed from bottle 24 the resultant weight force will necessarily be reduced. This will cause a corresponding reduction in the moment caused by this weight force.

At some point (preferably just as all water is dispensed from the bottle such that the resultant weight force is comprised substantially totally of the weight of the bottle per se) the moment caused by the weight force will be incrementally less than the moment caused by the switch force. At this point there will no longer be a balance of forces and the bottle will begin to rotate about the pivot ridge 43/right line of contact (in particular the line of contact about which the weight and switch moments are oppositely directed) in the direction of the switch moment (clockwise in FIG. 2). This rotation moves the lateral face against which the switch link abuts in the direction in which the switch link applies its switch force. As such, the switch link is also forced in this direction by the spring, with continued movement causing the switch to move from the first position to the second position, and allowing the actuator 58 to move to the extended position. The switch 50 may therefore be employed as an indicator that the bottle 24 has fully dispensed the water contained therein.

As is shown by comparison of FIGS. 1 and 2, the movement of the switch link 70 outward will cause a tipping of the bottle 24 about the pivot ridge 43 (right line of contact). The extent of this tipping has been exaggerated in FIG. 2, and is typically on the order of one degree. With this very small amount of tipping, it may be seen that the stop 36 is still in contact with the protrusion 40, such that the stopper 34 is still spaced from the opening 30, allowing the water to be fully expelled from the bottle 24. If this is not desired, the amount of tipping, tolerance on the stopper arrangement or both could be arranged to close the stopper and end dispensing upon tipping. This could be employed to dispense only a predetermined amount (i.e. weight) of water.

The use of a switch and a biasing means having relative rotation points as described above has the advantageous effect that the movement of the switch 50 and switch link 70 from the first position of FIG. 4 to the second position of FIG. 5 is extremely rapid and reliable. In contrast, it is believed that the use of a biasing means with a fixed direction of force along the direction of movement of the switch link (i.e. a standard compression spring) would allow the switch link 70 and switch 50 to move incrementally between the first and second positions. In other words, at the point the switch force moment was slightly greater than the weight force moment such a compression spring would move the switch link outward, but only to a position at which the switch and weight moments were again in balance. Such a position of the link would not necessarily be the fully extended second position, and it could require several of these movements to reach the second position.

Where the switch is at such an intermediate position slight movement of the humidifier, such as due to vibration induced by the fan, a heavy truck passing nearby or other incidental events, could cause slight movement of the switch with respect to the bottle. This could cause the switch to move prematurely (prior to expected depletion of the water in the bottle) into the second position. Even if the switch moves back to the intermediate position, the brief period in the second position could cause unintended and unwanted activation of the control circuitry.

With the present pivoted switch arrangement, however, the force exerted by the biasing means in the direction of the switch link can increase as the switch link moves outward. This increasing force ensures that a balance of forces will not be reached intermediate the second position. Once the weight force moment is less than the switch force moment, it remains less than the switch force moment, causing continued movement until the switch link is fully extended.

The movement of the switch from the first to the second position switches the switch from a first to a second condition, with the second condition causing a control function for the humidifier. For example, the switch may close a circuit by movement to the second position of FIG. 5, such that the switch illuminates a light which will serve as an indicator to the user that the bottle 24 should be refilled. Alternatively, the switch 50 can be moved to an open position when in the second position of FIG. 5 and be a part of the circuitry which operates the fan 22 or other equipment which causes the humidifier 10 to operate. As such, movement of the switch to the second position of FIG. 5 will cease operation of the humidifier fan, saving energy by not allowing the humidifier to run when there is little or no water within the humidifier.

Another alternative is to employ both arrangements, such that in the first condition the switch completes a circuit containing the motor, but breaks a circuit containing an indicator light. In the second position the switch would break the motor circuit, stopping operation of the humidifier, and complete the indicator light circuit, indicating to the user that operation was halted due to lack of water. This arrangement is preferred.

As is shown in FIG. 3, The humidifier base may contain two supports 42 for two water bottles, with the supports for the bottles having different heights in a manner shown in U.S. Pat. No. 4,921,639 to Chiu. This height difference will allow the uppermost bottle to completely drain prior to dispensing from the lowermost bottle. The uppermost bottle could be employed with a first switch 50 to illuminate a light indicating that the water supply is half exhausted, while the lowermost bottle could be employed with a second switch 50 to cease operation of the humidifier. It is preferred, however, that a single switch 50 be employed with the lowermost bottle only to reduce materials cost.

While it is typically preferable to cause deactivation of the humidifier upon depletion of the water, there are situations in which this is not the case. For example, the user may wish to run the fan after water depletion to fully dry the wicking elements prior to storage, replacement, etc. It is therefore preferred to include an override means to prevent deactivation of the humidifier.

Such override means could of course take many forms. For example, there could be provided a separate switch or other electrical/electronic component(s) which are within the control circuit. However, to reduce cost and complexity, it is preferred that the override means take the form of a catch on the switch link 70 which may selectively prevent movement of the switch to the second position of FIG. 5.

Figure 6:
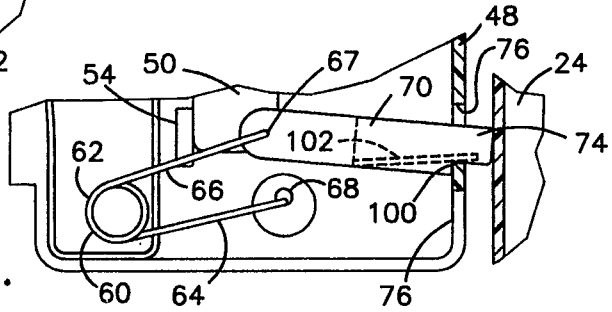
FIG. 6 is a detail view showing the switch of FIG. 3 in an override position.

With reference to FIGS. 4–6, the second end 74 of the switch link 70 includes an outwardly (i.e. in the direction of switch link movement) directed shoulder 100. The shoulder 100 is spaced from the outer edge of the free end 74 by a distance such that the shoulder is just interior of the inner face of the brace at the corresponding section of the guide hole 76 when the switch is in the first position of FIGS. 4 and 6.

With this arrangement, and by virtue of the pivoting of the switch link 70 about pivot point 67, the switch link may be manually pivoted such that the shoulder is placed in opposition to the inner face of the brace, with the spring force maintaining the switch link in this abutting position. As may be envisioned, when in the override position, the switch link may not move outward through the guide hole regardless of the amount of water within the bottle, or even the presence of a bottle. This arrangement requires only the formation of the shoulder 100, which may be easily accomplished during formation of the switch link.

It is preferred that where this catch arrangement is employed for override, there also is provided an arrangement to prevent unintentional override. This may advantageously be provided by a biasing tongue 102 on the switch link 70.

As is best shown by comparison of FIGS. 2, 5 and 6, the tongue 102 is pivoted to the switch link at a position inward of the shoulder 100 (best seen in FIG. 6), extends beyond the shoulder 100, and is biased to extend along the face of the switch link which contains the shoulder 100. As such, the tongue will tend to contact the guide hole 76 to urge the link 70 against pivoting into a position in which the shoulder 100 abuts the brace 48. The tongue thereby inhibits unintentional override of the switch.

However, as the tongue is pivotally biased, a predetermined amount of manual pressure of the type to place the shoulder in abutment with the brace will force the tongue to pivot and allow the shoulder to abut the brace 48, as shown in FIG. 6. This allows the user to manually move the link 70 to the side (or possibly up or down) to engage the link with the brace 48 and engage the override feature. Manual movement in the opposite direction will disengage the shoulder from the brace 48 to disengage the override feature. The tongue will automatically return to the position of FIG. 5, due to the resilient or biased mounting of same. Preferably, the link 70, shoulder and tongue are formed as a monolithic unit, with the tongue 102 forming an encastered bending beam spring structure.

As a slight variation, the shoulder could be spaced slightly outward of the inner face of the brace 48, and the first position of FIG. 4 could have the actuator 58 not fully withdrawn into the switch casing, yet sufficiently withdrawn for the switch to be in the first condition. This arrangement would require the user to manually press the link 70 inward, until actuator 58 is fully withdrawn, before the shoulder could engage the inner face. This arrangement would require greater attention to tolerances, but could allow elimination of the tongue 102.

A second control system according to the present invention is shown in FIGS. 1 and 2. Specifically, the brace 48, or some other structure associated with the base 12, mounts an interlock switch 82 having appropriate wires 84 associated therewith such that the interlock switch is part of the circuit for the fan 22 or other equipment to operate the humidifier 10. The interlock switch 82 includes an actuator button 86 which is directed upward such that the actuator may be moved between first and second positions by movement in a substantially vertical direction. The brace 48 or other such structures includes at least an opening 88 above the actuator button 86 such that the button may be accessed from above.

The lid 14 includes a projecting finger 90 which is located on the lid in a position such that the finger will be located above the actuator button 86 when the lid is in the closed position of FIG. 1. The finger also has a length such that it may press the actuator button inward to a first position when the lid is in the fully closed position. As such, when the lid has been removed by the user to refill the water bottle or for other purposes, the finger 90 will be removed from contact with the actuator button 86, allowing it to move to its second position. In this manner the interlock switch 82 may be moved from open to closed positions, such that the fan 22 or other operative equipment will be disabled when the lid 14 has been removed from its closed position upon the base 12. This arrangement ensures that the user will not have access to the interior of the humidifier, and potentially hazardous equipment, when such equipment is running.

Figure 8:
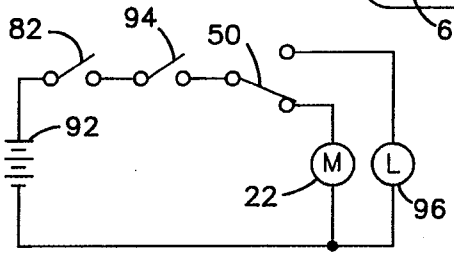
FIG. 8 is a circuit diagram showing a control circuit according to the present invention.

FIG. 8 shows a diagram of a preferred control circuit for the humidifier. The circuit includes a power source 92, typically household current. The interlock switch 82 is located within the circuit in series, as is a humidistat switch 94. The switch 50 is also provided, allowing switching between a first circuit branch containing the motor 22 and a second branch containing an indicator light 94.

In operation the lid must be placed on the base to close switch 82, the humidity must be sufficiently low to close humidistat 94, and there must be sufficient water in the bottle to place switch 50 in its first condition in order for a first complete circuit to be formed and the humidifier to operate. If the lid is raised or the humidity reaches a predetermined level, the appropriate switch 84 or 94 will open and cease operation of the motor, and thus the humidifier. During operation of the humidifier, if the water in the bottle is exhausted the switch 50 will move to the second position and stop the motor while activating the indicator light.

As noted above, the opening of the lid or the humidity level will cause the switches 84 and 94 to open. When the switch 50 is in the second position to activate the indicator light, opening of the other switches will break the circuit to the light, causing it to be extinguished. This may be preferred to save energy. Alternatively, the switch 82 and/or 94 can be placed within the branch containing motor 50, such that the indicator light will remain activated even if switch 82 and/or 94 are opened. This arrangement will provide a constant reminder of the low water supply by way of the indicator light.

It should be noted that various modifications may be made to the physical arrangements of the first control switch arrangement to determine a low water supply. In particular, the main requirements are that the support below the bottle be in a position horizontally spaced from the center of gravity of the bottle, the biased switch link be located such that the force it exerts be spaced from the support and cause a moment about the support opposite that caused by the weight of the bottle, and that the support and bottle abutment be capable of sufficient tilting to allow the Switch link to move from the first to the second position. These requirements may be met in may ways.

For example, so long as the line of tilting is spaced from the center of gravity of the bottle, the upper surface 44 of right support 42 could be horizontal, an apex of a triangle, or other configurations.

It is also not strictly necessary that the switch link abut the lateral wall of the bottle, so long as the proper moment is created by the switch force. However, the present arrangement of placing the switch 50 and switch link 70 to exert a lateral force upon the bottle 24 provides advantages effects.

Specifically, when an air bubble passes through the water contained in bottle 24, to relieve the vacuum within the bottle 24 and allow the bottle to dispense, the displacement of the water around this air bubble tends to move the bottle 24. However, the air bubble travels essentially straight up, such that the resultant force of the water displacement is believed to be generally vertical. If the switch were placed for vertical or upward movement, the vertical "bubble force" could reduce the weight of the bottle (as felt by the switch) sufficiently to cause premature actuation. By placing the switch for providing a lateral force, the vertical movement of the bottle 24 has little or no effect upon the force exerted upon the switch link 70, substantially eliminating the chance of premature movement to the second position.

It is noted, however, that the displacement of the water about the air bubble, with the resultant release of the vacuum within the bottle, may tend to cause a bowing or flexing of the sidewalls of the bottle inward and outward. As may be envisioned, this lateral movement of the bottle walls will have an effect upon a laterally placed switch and switch link. As such, it is preferred that the switch link 70 be placed at a position such that it abuts the bottle 24 near or in proximity to a corner, end or other area of the bottle which will experience little or no lateral flexure during dispensing.

In the present invention it is advantageous to form a handle in the water bottle at the end opposite that having neck 26. This handle, as is known in the art, allows the user to easily place the bottle within and remove the bottle from the humidifier. Such a handle may be provided by forming a channel or opening through the lateral dimension of the bottle and reducing the lateral extent of the channel at its outer edge to form a cross bar 78 which may be manually grasped by the user.

This arrangement allows the switch link 70 to be located adjacent the inner side of such a channel, such that the switch link is located at a position which will have little lateral flexure during dispensing, and which is below the anticipated insertion depth of the user's hand, such that the user does not unintentionally contact the switch link 70.

A similar channel and cross bar 80 may be formed at the opposite end of the bottle 24, i.e. adjacent the neck 26, but offset in the direction into the page in FIG. 1. This handle will allow the user to readily lift the bottle immediately after it has been filled (which must be performed with the neck being uppermost). During this time the bottle is typically sitting upon the floor such that the cross bar 78 is not accessible. The provision of this second cross bar 80 thus provides much greater convenience for the user.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. For example, the articulated biasing means of FIG. 4 which may provide an increasing force could be employed to positively move the bottle upward, rather than causing rotation or tilting. Additionally, the biasing means could be simply a mechanical linkage, with the switch 50 replaced by a rigid link and the switch located as a separate element spaced therefrom, but moving in response to the movement of the bottle. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A humidifier, comprising:

an outer casing;

means mounted in said casing for evaporating water in said casing;

a removable water bottle mounted to said casing to automatically dispense water into said casing;

a biased abutment portion mounted to said casing for movement between first and second positions, said abutment portion abutting said water bottle and transferring a force to said bottle, said force increasing during said movement from said first to said second position, said force in said first position being insufficient to cause motion of said bottle when said bottle is filled with water, and said force being sufficient in said first position to cause said motion of said bottle when said bottle contains a predetermined amount of water less than that to fill said bottle; and switch means mounted to said casing for movement between first and second positions in response to said motion of said bottle, said switch means in said first position allowing an action selected from the class consisting of operating said means for evaporating water, deactivating a signal, and operating said means for evaporating water and deactivating a signal, and in said second position allowing an action selected from the class consisting of deactivating said means for evaporating water, activating said signal, and deactivating said means for evaporating water and activating a signal.

2. A humidifier as in claim 1, wherein said switch means is operatively located within a control circuit including said means for evaporating water in parallel with an indicator light, and wherein aid first position of said switch means completes said circuit through said evaporating means while opening said circuit through said light, and in said second position of said switch means completes said circuit through said light while opening said circuit through said evaporating means.

3. A humidifier as in claim 1, wherein said direction of said force is not substantially opposite to the weight of said bottle.

4. A humidifier as in claim 3, wherein said abutment portion includes:

a first element mounted to said casing for pivoting about a pivot rod, said first element including a pivot point spaced from said pivot rod, said first element and therefore said pivot point pivoting about said pivot rod between first and second positions;

a biasing spring having a first end mounted to said first element at said pivot point and a second end mounted to said casing at a pivot axis, said pivot axis being spaced from said pivot rod and said pivot point, and an imaginary line extending between said pivot rod and said pivot axis, said biasing spring providing a compressive biasing force in a direction including said first and second ends;

a switch link having a first end pivotally mounted to said first element at said pivot point and a second end abutting said bottle to transfer said force to said bottle, said switch link extending at an angle to said imaginary line whereby pivotal movement of said first element causes movement of said switch link; and wherein said pivot point is closer to said imaginary line when in said first position than in said second position, whereby the component of said biasing force perpendicular to said imaginary line increases during movement from said first to said second position, the component being insufficient to cause said motion of said bottle when said bottle is full, but being sufficient to cause said motion of said bottle when said bottle contains said predetermined amount.

5. A humidifier as in claim 4, wherein said first element comprises said switch means.

6. A humidifier as in claim 5, wherein movement of said switch link, as said switch means moves from said first to said second position, is substantially horizontal.

7. A humidifier as in claim 1, wherein said abutment portion includes:

a first element mounted to said casing for pivoting about a pivot rod, said first element including a pivot point spaced from said pivot rod, said first element and therefore said pivot point pivoting about said pivot rod between first and second positions;

a biasing spring having a first end mounted to said first element at said pivot point and a second end mounted to said casing at a pivot axis, said pivot axis being spaced from said pivot rod and said pivot point, and an imaginary line extending between said pivot rod and said pivot axis, said biasing spring providing a compressive biasing force in a direction including said first and second ends;

a switch link having a first end pivotally mounted to said first element at said pivot point and a second end abutting said bottle to transfer said force to said bottle, said switch link extending at an angle to said imaginary line whereby pivotal movement of said first element causes movement of said switch link; and wherein said pivot point is closer to said imaginary line when in a first position than in a second position, whereby the component of said biasing force perpendicular to said imaginary line increases during movement from said first to said second position, the component being insufficient to cause said motion of said bottle when said bottle is full, but being sufficient to cause said motion of said bottle when said bottle contains said predetermined amount.

8. A humidifier as in claim 7, wherein said first element comprises said switch means.

9. A humidifier as in claim 8, wherein movement of said switch link, as said switch means moves from said first to said second position, is substantially horizontal.

10. A humidifier, comprising:

an outer casing;

means mounted in said casing for evaporating water in said casing;

a removable water bottle mounted to said casing to automatically dispense water into said casing;

a support for said water bottle in said casing below said water bottle; and a biased abutment portion mounted to said casing for movement between first and second positions and abutting said water bottle at a location spaced from said support and transferring a force to cause a moment in said bottle about said support, said moment being incapable of causing motion of said bottle when said bottle is full, but being capable of causing said motion of said bottle when said bottle contains a predetermined amount of water less than that to fill said bottle, said abutment portion including a first element mounted to said casing for pivoting about a pivot rod, said first element including a pivot point spaced from said pivot rod, said first element and therefore said pivot point pivoting about said pivot rod between first and second positions;

a biasing spring having a first end mounted to said first element at said pivot point and a second end mounted to said casing at a pivot axis, said pivot axis being spaced from said pivot rod and said pivot point, and an imaginary line extending between said pivot rod and said pivot axis, said biasing spring providing a compressive biasing force in a direction including said first and second ends;

a switch link having a first end pivotally mounted to said first element at said pivot point and a second end abutting said bottle to transfer said force to said bottle, said switch link extending at an angle to said imaginary line whereby pivotal movement of said first element causes movement of said switch link; and wherein said pivot point is closer to said imaginary line when in a first position than in a second position, whereby the component of said biasing force perpendicular to said imaginary line increases during movement from said first to said second position, the component being insufficient to cause said motion of said bottle when said bottle is full, but being sufficient to cause said motion of said bottle when said bottle contains said predetermined amount; and switch means mounted to said casing for movement between first and second positions in response to said motion of said bottle, said switch means in said first position allowing an action selected from the class consisting of operating said means for evaporating water, deactivating a signal, and operating said means for evaporating water and deactivating a signal, and in said second position allowing an action selected from the class consisting of deactivating said means for evaporating water, activating said signal, and deactivating said means for evaporating water and activating a signal.

11. A humidifier as in claim 10, wherein said direction of said force is not substantially opposite to the weight of said bottle.

12. A humidifier as in claim 10, wherein said moment is a first moment, and said support is offset horizontally from the center of gravity of said bottle, whereby the weight of said bottle and water create a second moment about said support, said second moment being in a direction opposite to that of said first moment, said first moment being less than said second moment when said bottle is full, but being greater than said second moment when said bottle contains said predetermined amount of water.

13. A humidifier as in claim 10, wherein said switch means is operatively located within a control circuit including said means for evaporating water in parallel with an indicator light, and wherein said first position of said switch means completes said circuit through said evaporating means while opening said circuit through said light, and in said second position of said switch means completes said circuit through said light while opening said circuit through said evaporating means.

14. A humidifier as in claim 10, wherein said first element comprises said switch means.

15. A humidifier as in claim 14, wherein movement of said switch link, as said switch means moves from said first to said second position, is substantially horizontal.

16. A humidifier, comprising:

an outer casing;

means mounted in said casing for evaporating water in said casing;

a removable water bottle mounted to said casing to automatically dispense water into said casing;

a biased abutment portion mounted to said casing for movement between first and second positions, abutting said water bottle and transferring a force to cause motion of said bottle during said movement, said force being incapable of causing said motion of said bottle when said bottle is full, but being capable of causing said motion of said bottle when said bottle contains a predetermined amount of water less than that to fill said bottle, said abutment portion having a free end adapted to abut against said water bottle, said free end passing through an opening fixed with respect to said casing, said abutment portion including a shoulder capable of being placed in opposing relation to said opening to thereby prevent said movement of said abutment portion, and thus said motion of said bottle; and switch means mounted to said casing for movement between first and second positions in response to said motion of said bottle, said switch means in said first position allowing an action selected from the class consisting of operating said means for evaporating water, deactivating a signal, and operating said means for evaporating water and deactivating a signal, and in said second position allowing an action selected from the class consisting of deactivating said means for evaporating water, activating said signal, and deactivating said means for evaporating water and activating a signal.

17. A humidifier as in claim 16, wherein said abutment portion further comprises a tongue pivoted at a position spaced from said free end beyond said shoulder, said tongue being biased into a normal position extending beyond said shoulder to prevent unintentional placement of said shoulder in opposition to said opening, and being resiliently mounted to said abutment portion for movement into a position allowing said shoulder to be placed in said opposing relation to said opening.

* * * * *